United States Patent [19]

Shaffer

[11] 4,403,973

[45] Sep. 13, 1983

[54] PHOTOFLASH LAMP STRUCTURE AND FABRICATION PROCESS

[75] Inventor: John W. Shaffer, Williamsport, Pa.

[73] Assignee: GTE Products Corporation, Stamford, Conn.

[21] Appl. No.: 270,288

[22] Filed: Jun. 4, 1981

[51] Int. Cl.[3] ..... H01J 9/18

[52] U.S. Cl. ..... 445/28; 431/362

[58] Field of Search ..... 431/357, 358, 362, 365; 313/318; 29/25.13, 25.16; 445/28, 38, 42

[56] References Cited

U.S. PATENT DOCUMENTS

| | | | |
|---|---|---|---|
| 3,602,619 | 8/1971 | Van der Tas et al. | 431/362 |
| 3,721,515 | 3/1973 | Boekkooi et al. | 431/362 |
| 4,270,897 | 6/1981 | Armstrong et al. | 431/362 |

*Primary Examiner*—Samuel Scott
*Assistant Examiner*—Carl D. Price
*Attorney, Agent, or Firm*—Thomas H. Buffton

[57] ABSTRACT

A photoflash lamp includes a glass envelope having a pair of electrical conductors forming a recessed seal with a primer material bridging the electrical conductors and extending into the recessed seal to contact the electrical conductors. Also, a process for fabricating a photoflash lamp is provided wherein the electrical conductors and glass envelope are moved with respect to one another to provide a recess in the envelope adjacent the electrical conductors. A primer material in liquid form is bridged across the electrical conductors and subjected to a vacuum to insure removal of any gap between the electrical conductors and the primer material.

6 Claims, 4 Drawing Figures

PHOTOFLASH LAMP STRUCTURE AND FABRICATION PROCESS

TECHNICAL FIELD

This invention relates to photoflash lamps and a process for fabricating photoflash lamps and more particularly to photoflash lamps and a photoflash lamp fabricating process wherein at least one of a pair of electrical conductors is recessed in the seal of a glass tube and a primer material extends into the recess to contact the one electrical conductor and form a bridge to the other electrical conductor.

BACKGROUND ART

In the photoflash lamp art, it is a common practice to activate the lamp electrically from a low-voltage or a high-voltage source. Ordinarily, lamps utilizing a low-voltage source include a filament which bridges a pair of electrical conductors. This filament is heated in an amount sufficient to ignite a primer material which, in turn, ignites a combustible filamentary or shred material and provides the desired light output from the lamp.

The high-voltage type of photoflash lamp does not require the above-mentioned filament but rather relies upon a primer material which bridges a pair of electrical conductors. Upon application of a relatively high voltage, several hundred to several thousand volts, to the electrical conductors, the primer material is ignited and a combustible filamentary or shred material is activated to provide the desired light output.

In the constant search for improved light output and a reduced lamp size, it has been observed that the filamentary type lamp utilizing a low voltage source is inconsistent with the desired maximum light in a minimum space concept. Specifically, the mount structure required tends to undesirably reduce the space available within the flashlamp envelope which may be utilized to house light-producting material. Thus, the ratio of light attainable per unit space is undesirably limited.

An effort to overcome the above-described undesirable limitations is the utilization of a high-voltage electrical source. In this manner, the need for a filament is reduced and it becomes possible to rely on a layer of primer material bridging the electrical conductors as a source for igniting the combustible material within the lamp. Thus, the space for filament and filament supporting structures becomes available for utilization in providing light output.

However, one of the problems encountered when a primer material is employed as a bridge between a pair of electrical conductors is a condition which might be termed "Shred Shorting." Therein, the shred or combustible filamentary material utilized to provide light output comes in contact with the electrical conductor. As a result, the current passes through the shred material rather than the primer material and the primer material is, in effect, short-circuited. Thus, ignition of the primer material fails to take place and a flash failure results.

One of the known attempts to overcome the above-described "shred shorting" condition is described in U.S. Pat. No. 3,602,619. Therein, a glass tube, 19 or 21, is utilized to insulate the primer material from the shred material and thereby inhibit "shred shorting." However, it can be seen that the glass tube and mount structure is deleterious to a maximum utilization of available space for light producing capabilities.

Another known flashlamp configuration for reducing the tendency toward "shred shorting" is illustrated in U.S. Pat. No. 4,229,161. Herein, a mica disc is utilized to separate the primer and combustible materials. However, it may be noted that the disc and mount structure require space which would be better utilized as an area containing light producing materials.

Still another flashlamp configuration for maximizing light output per unit space is illustrated in the prior art embodiment of FIG. 1 of the drawings. Herein, a pair of electrical conductors 5 and 7 protrude through the seal 9 and into the inner volume 11 of a flashlamp envelope 13. A layer of primer material 15 bridges the electrical conductors 5 and 7 and combustible filamentary or shred material 17 is disposed within the envelope 13.

Although the above-described structure enhances the light output per unit space of the flashlamp, it was found that the electrical conductors 5 and 7 protruding into the envelope 13 tended to contact the shred material 17. As a result, the primer material 15 is undesirably short-circuited by the shred material 17 and flash failures result.

OBJECTS AND SUMMARY OF THE INVENTION

An object of the present invention is to provide an improved photoflash lamp. Another object of the invention is to enhance the light output per unit space capabilities of a photoflash lamp. Still another object of the invention is to provide an improved photoflash lamp fabrication process. A further object of the invention is to enhance the fabrication process of an improved photoflash lamp.

These and other and further objects, advantages and capabilities are achieved in one aspect of the invention by a photoflash lamp having a combustion-supporting gas and combustible filamentary material disposed within a glass envelope and an ignition means including a primer material and a pair of electrical conductors sealed into one end of the envelope with at least one of the electrical conductors recessed within the sealed end of the envelope and the primer material extending into the recess and contacting the electrical conductor.

Also, a photoflash lamp fabrication process is provided wherein a glass tube having openings at opposite ends is supported, a pair of electrical conductors introduced into one end, heat applied to cause the glass tube to surround the electrical conductors, the electrical conductors and glass tube are moved in a direction opposite to one another to form a recessed portion in the glass tube seal surrounding at least one of the electrical conductors, a liquid primer material is bridged between the electrical conductors, the glass tube is evacuated and the vacuum released to cause the liquid primer material to contact the ends of the electrical conductors, a shred material is deposited in the glass tube and the end of the glass tube is sealed to provide a hermetically sealed envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
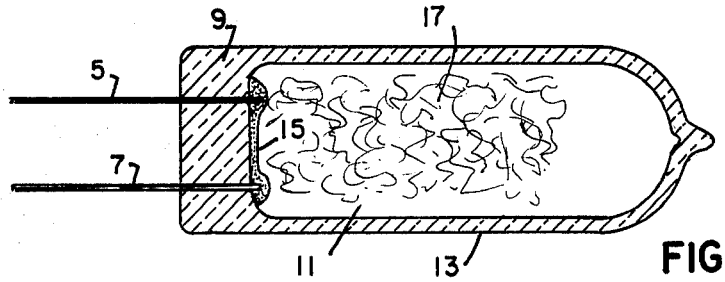
FIG. 1 PRIOR ART
FIG. 1 is a prior art photoflash lamp illustrating a maximized utilization of space for producing emitted light.
Figure 2:
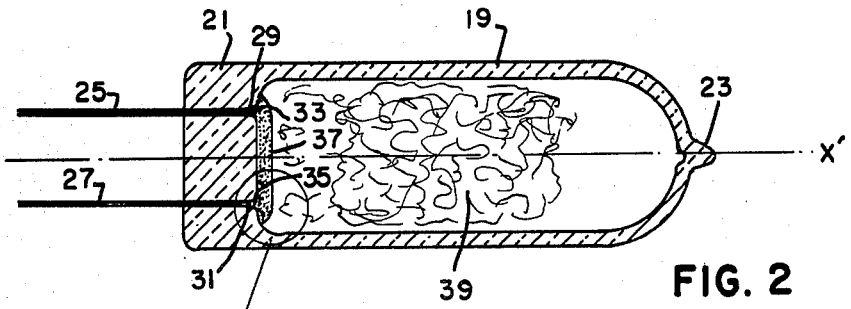
FIG. 2 is a preferred embodiment of the photoflash lamp of the invention.
Figure 3:
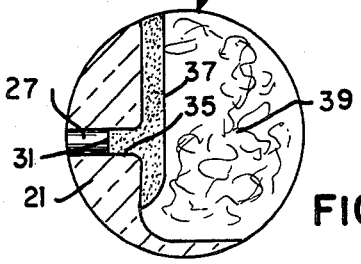
FIG. 3 is an enlarged cross-sectional view of the recessed portion of the embodiment of FIG. 2.

Referring to the drawings, FIGS. 2 and 3 illustrate a preferred form of photoflash lamp. Therein, a glass envelope 19 has a first sealed end 21 and an oppositely disposed second sealed end 23. The glass envelope 19 has a longitudinal axis X' and a pair of electrical conductors 25 and 27 extend in planes parallel to the longitudinal axis X' of the envelope 19.

The electrical conductors 25 and 27, in this embodiment, each have an end portion 29 and 31 which is sealed into the first sealed end 21 of the glass envelope 19. A recess 33 and 35 in the sealed end 21 is located immediately adjacent each one of the end portions 29 and 31. Also, a primer material 37 extends into each one of the recesses 33 and 35, contacts the end portions 29 and 31 of the electrical conductors 25 and 27 on the interior of the glass envelope 19. Moreover, a shred material 39 is located within the glass envelope 19 and a combustion-supporting gas such as oxygen is disposed within the glass envelope 19 and surrounds the shred material 37.

Figure 4:
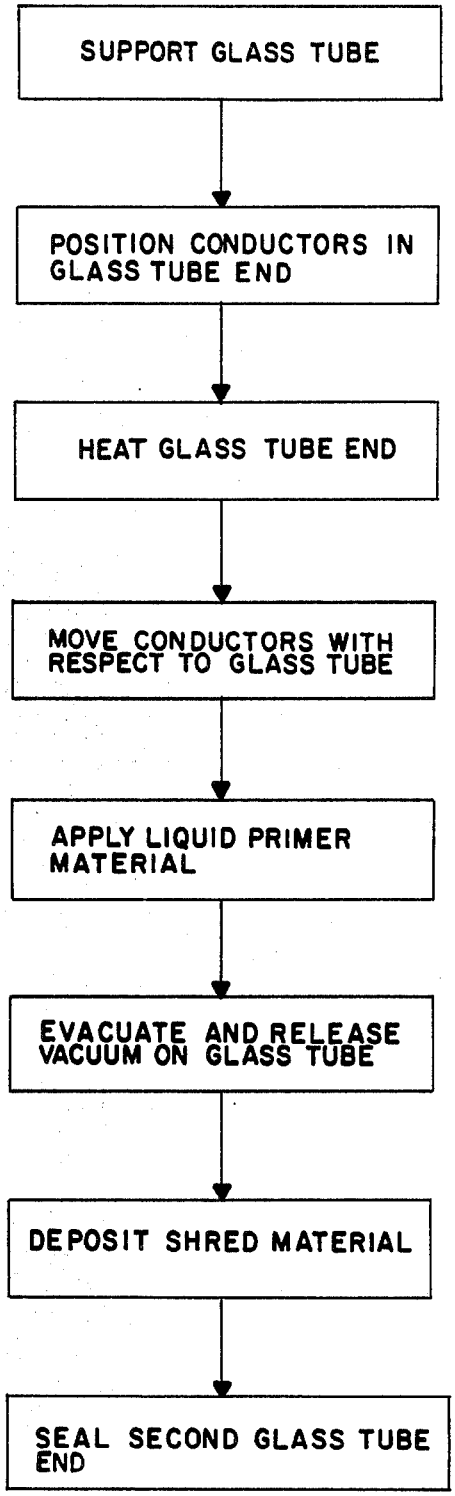
FIG. 4 is a flow chart illustrating a preferred process for fabricating the photoflash lamp of FIG. 2.

As to the fabrication of the above-described unique photoflash lamp illustrated by the flow chart of FIG. 4, a light transmittable elongated glass tube with first and second oppositely disposed open ends is supported and a pair of electrical conductors are positioned within a first open end of the glass tube. The electrical conductors are in planes parallel to the longitudinal axis of the glass tube and heat is applied to the first open end of the glass tube in an amount sufficient to collapse the glass tube and cause the formation of a glass seal surrounding the electrical conductors.

While the glass seal surrounding the electrical conductors is still in a plastic state, the glass tube and electrical conductors are moved in opposite directions with respect to one another. As a result, a recess is formed in the glass seal immediately adjacent the ends of the electrical conductors and extending to the interior of the glass envelope. A primer material in liquid form is then applied intermediate the pair of electrical conductors interiorly of the glass tube.

Since the primer material tends to undesirably form a gap intermediate thereto and the ends of the electrical conductors, the glass tube is evacuated while the primer material is still in liquid form and the vacuum is then released. Thereupon, the gap intermediate the primer material and the ends of the electrical conductors is eliminated and the desired contact therebetween is established.

Following, a quantity of combustible filamentary or shred material is deposited in the glass envelope and the opposite or second open end of the glass tube is sealed to provide a hermetically sealed envelope. Moreover, a combustion-supporting gas, such as oxygen, may be introduced into the glass tube by way of the second open end prior to the sealing thereof to provide the hermetically sealed envelope.

Thus, there has been provided a unique photoflash lamp having a maximized light emission to available space capability. The improved lamp structure virtually eliminates all mount structure thereby providing additional space for light emitting material storage. Also, the recessed electrical conductor connections tend to inhibit undesired "shred shorting" wherein the primer material is short-circuited by shred material and undesired flash failure is encountered.

Additionally, an enhanced photoflash lamp fabricating process is provided whereby the electrical conductors are not only recessed into the glass seal of the envelope to inhibit "shred shorting" but undesired air gaps intermediate the electrical conductor and the primer material are also eliminated. Moreover, the process is inexpensive of materials and labor while providing enhanced light emissions per unit space capabilities.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

A unique photoflash lamp has been provided which is especially suitable to a miniaturized configuration while providing maximized light output per unit lamp volume. The lamp is not only light efficient but in addition provides flash reliability by inhibiting undesired "shred shorting" of the primer material. Also, the lamp is cost effective due to the primer bridge configuration whereupon extra beads, glass tubes and frits are not required.

Additionally, a photoflash lamp fabrication process is provided which is inexpensive of materials and labor while providing a lamp of enhanced reliability. The process not only insures a desired recess of the electrical conductors to insure reliable primer activation and reduction of undesired flash failure due to shred short circuiting but also insures good contact between the electrical conductors and the primer material by utilizing a vacuum technique.

I claim:

1. A photoflash lamp fabricating process comprising the steps of:

supporting an elongated glass tube with oppositely disposed first and second open ends;

positioning a pair of electrical conductors within said first open end of said glass tube, each of said electrical conductors having an inward end within said glass tube;

heating said first open end of said glass tube to cause said glass tube to collapse and provide a seal surrounding said pair of electrical conductors;

moving said pair of electrical conductors and said glass tube in opposite directions to cause said inward end of at least one of said pair of electrical conductors to form a recessed portion in said seal surrounding said electrical conductor with said recessed portion extending from said inward end of said electrical conductor to the interior of said glass tube;

applying a primer material in liquid form bridging said pair of electrical conductors internal of said glass tube;

evacuating and releasing the vacuum on said glass tube to cause said liquid primer material to contact said inward end of at least one of said pair of electrical conductors within said recessed portion of said seal of said glass tube and to extend to the other one of said electrical conductors;

depositing a quantity of combustible filamentary material within said glass tube having a sealed first end; and sealing said second open end of said glass tube to provide a hermetically sealed glass envelope.

2. The photoflash lamp fabricating process of claim 1 wherein said glass tube has a longitudinal axis extending between said first and second open ends and said pair of electrical conductors each have a longitudinal axis in a plane substantially parallel to said longitudinal axis of said glass tube.

3. The photoflash lamp fabricating process of claim 1 including the step of introducing a combustion-supporting gas into said glass tube by way of said second open end prior to sealing said second open end to provide a hermetically sealed glass envelope.

4. The photoflash lamp fabricating process of claim 1 including the step of introducing oxygen into said glass tube through said second open end prior to the sealing thereof to provide a hermetically sealed glass envelope.

5. The photoflash lamp fabricating process of claim 1 wherein each one of said pair of electrical conductors form a recessed portion in said seal upon diametrically opposite movement of said electrical conductors and glass tube with respect to one another.

6. The photoflash lamp fabricating process of claim 1 wherein said pair of electrical conductors each have an inward end in a recessed portion of said seal and said glass tube is evacuated and the vacuum released to cause said liquid primer material to contact said inward end of said pair of electrical conductors.

* * * * *